US006695352B2

(12) United States Patent
Park et al.

(10) Patent No.: US 6,695,352 B2
(45) Date of Patent: Feb. 24, 2004

(54) EXTENSION TUBE IN VACUUM CLEANER

(75) Inventors: Deog Bae Park, Kyongsangnam-do (KR); Hoi Kil Jeong, Kyongsangnam-do (KR); Man Tae Hwang, Kyongsangnam-do (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/020,984

(22) Filed: Dec. 19, 2001

(65) Prior Publication Data

US 2002/0101075 A1 Aug. 1, 2002

(30) Foreign Application Priority Data

Jan. 29, 2001 (KR) ..... P2001-4119
Sep. 20, 2001 (KR) ..... P2001-58277

(51) Int. Cl.[7] ..... A47L 9/24

(52) U.S. Cl. ..... 285/7; 15/414; 285/86; 285/282; 285/317

(58) Field of Search ..... 15/377, 417, 415.1, 15/410, 327.1–327.7; 285/7, 86, 127.1, 149.2, 148.21, 148.2, 282, 272, 273, 317, 184

(56) References Cited

U.S. PATENT DOCUMENTS 4,372,584 A 2/1983 Miller
4,639,018 A * 1/1987 Froelich et al. ..... 285/184
5,101,534 A 4/1992 Watanabe et al.
5,927,758 A * 7/1999 Carlsson ..... 285/7
5,996,175 A * 12/1999 Fusco ..... 15/410
6,345,408 B1 * 2/2002 Nagai et al. ..... 15/361

FOREIGN PATENT DOCUMENTS

| | | |
|---|---|---|
| EP | 0 875 195 A1 | 11/1998 |
| EP | 1 031 312 A1 | 8/2000 |
| FR | 2 772 585 | 6/1999 |
| SE | 9802315 A | 12/1999 |
| WO | WO 00/65978 A1 | 11/2000 |

* cited by examiner

*Primary Examiner*—Lynne R. Browne
*Assistant Examiner*—Aaron Dunwoody
(74) *Attorney, Agent, or Firm*—Birch, Stewart, Kolasch & Birch, LLP

(57) ABSTRACT

An extension tube in a vacuum cleaner includes a lower extension tube for drawing dust laden air through an air suction nozzle fitted at one end, an upper extension tube having one end connected to a hand grip extended to a body of the vacuum cleaner for passing the dust laden air drawn through the lower extension tube, a joint part connected to the other ends of the lower extension tube and the upper extension tube for making the lower extension tube and the upper extension tube foldable relative to each other to a preset angle, and a locking arrangement for locking the joint part to fold/unfold the joint part selectively, thereby permitting a user to fold the upper and lower extension tubes, and to carry out an easy cleaning of even an underside of a sofa or a bed without bending the user's body, thereby enhancing the user's convenience.

26 Claims, 8 Drawing Sheets

EXTENSION TUBE IN VACUUM CLEANER

BACKGROUND OF THE INVENTION

1. Field of the Invention

The present invention relates to a vacuum cleaner, and more particularly, to an extension tube, connecting an air suction nozzle for drawing dust laden air, and a hose extended from a body of a vacuum cleaner, in a vacuum cleaner, which can be folded to an angle desired by a user.

2. Background of the Related Art

FIG. 1 illustrates a perspective view of a related art vacuum cleaner, referring to which the related art vacuum cleaner will be explained.

In general, the related art vacuum cleaner is provided with body 1 having a suction motor (not shown), filter means (not shown), and power supply means for supplying power, a suction hose 3 connected to one end of the body 1, for guiding flow of dust laden air so that the dust is drawn to an inside of filter means inside of the body 1, a hand grip 5 connected to the other end of the suction hose 3 having operation buttons for operation of the vacuum cleaner, an air suction nozzle 10 having a suction hole (not shown) for drawing the dust laden air through the suction hose 3, and an extension tube 7 connected between the air suction nozzle 10 and the hand grip 5 for guiding flow of the dust laden air drawn through the air suction nozzle 10 toward the suction hose 3.

The operation of the related art vacuum cleaner will be explained.

Upon putting the vacuum cleaner into operation by pressing a button on the hand grip 5, the suction motor in the body 1 comes into operation, to generate a suction force in the body by a rotation force of the motor. Then, dust and foreign matter laden air, drawn through the suction hole in the suction nozzle 10 by the suction force of the suction motor, is drawn into the body 1 through a lower extension tube 7*b*, an upper extension tube 7*a*, the hand grip 5, and the suction hose 3 in succession. After the dust and foreign matter is filtrated at the filter means in the body 1, the air is discharged outside of the body 1.

However, the related art extension tube 7 of a vacuum cleaner has the following problems.

The extension tube 7, extendable on a straight line as much as desired by coupling the upper extension tube 7*a* and the lower extension tube 7*b* by a coupling tube 9, permits to clean a place as far as possible without reaching to the place by himself. However, when the user intends to clean places, such as under a sofa, a bed, or the like, since the extension tube 7 is long, it is required to hold the extension tube 7 parallel to a floor horizontally, and bend the body accordingly, for making the suction nozzle 10 to reach deep under the sofa, or the bed the user desires. That is, the user's holding the extension tube 7 horizontally, and bending user's body in cleaning under side furniture, such as a sofa, or a bed is troublesome, and tiresome, and may cause a trouble in the user's waist.

SUMMARY OF THE INVENTION

Accordingly, the present invention is directed to an extension tube in a vacuum cleaner that substantially obviates one or more of the problems due to limitations and disadvantages of the related art.

An object of the present invention is to provide an extension tube in a vacuum cleaner, which permits cleaning places under furniture, such as a sofa, or a bed, without holding the extension tube parallel to a floor horizontally, and bending the user's body, for reducing tiredness, and enhancing convenience of the user.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the extension tube in a vacuum cleaner includes a lower extension tube for drawing dust laden air through an air suction nozzle fitted at one end, an upper extension tube having one end connected to a hand grip extended to a body of the vacuum cleaner for passing the dust laden air drawn through the lower extension tube, a joint part connected to the other ends of the lower extension tube and the upper extension tube for making the lower extension tube and the upper extension tube foldable relative to each other to a preset angle, and locking means for locking the joint part to fold/unfold the joint part, selectively.

The joint part may include a first tube having one end connected to the lower extension tube, a second tube having one end connected to the upper extension tube, a rotatable coupling part for making the other ends of the first tube, and the second tube to be in communication, and coupling the first tube and the second tube to be foldable relative to each other to the preset angle, and coupling part covers fitted to an outside of the rotatable coupling part not to interfere the rotation of the rotatable coupling part, and coupled to an outside circumference of the first tube, coaxially.

The joint part may include a first tube having one end connected to the lower extension tube, a second tube having one end connected to the upper extension tube, a rotatable coupling part for making the other ends of the first tube, and the second tube to be in communication, and coupling the first tube and the second tube to be foldable relative to each other to the preset angle, and circular plates covered on sides of the rotatable coupling part, and rotatably fitted together with the first tube.

The rotatable coupling part includes a cylindrical hollow receptor part formed at the other end of the first tube to have an axis perpendicular to an axis of the first tube, and having an opening in an outside circumference in communication with the second tube, and a cylindrical hollow inserting part formed at the other end of the second tube so as to be inserted inside of the receptor part to serve as a rotation shaft of the first tube, and having an opening in an outside circumference in communication with the first tube.

The receptor part preferably has a recess in the opening thereof in a rotation direction of the second tube for allowing the second tube to rotate a preset angle with respect to the first tube, and the receptor part preferably has an opening in one side for inserting the inserting part in an axial direction.

The locking means includes a locking projection on each of the cylindrical parts of the coupling part covers of the joint part, a locking member movably fitted on the second tube along an axis direction thereof having engagement parts for engaging with the locking projections to restrict rotation of the joint part, and elastic supporting means for is exerting an elastic force to the locking member in a direction of engagement of the engagement parts with the locking projections.

The locking member includes an inside diameter greater than an outside diameter of the second tube, and the engagement parts in an inside circumference, and the second tube of the joint part has guide projections on an outside circumference for guiding the engagement parts along an axis direction of the second tube.

The elastic supporting means includes a step on an inside circumference of the locking member, a supporting member fixed to the second tube, and a compression spring having ends biased on the step and the supporting member for exerting an elastic force to the locking member in a direction the engagement parts engage with the locking projections.

The joint part is fitted to the lower extension tube, or the upper extension tube.

The locking means may include a lever at the hand grip, wire having one end connected to the lever, a locking projection connected to the other end of the wire, and fitted to the upper extension tube, and a locking hole in one side circular plate for restricting rotation of the joint part as a part of the locking projection is inserted therein.

Preferably, the locking projection is rotatably fitted to the upper extension tube for selective insertion in the locking hole as the wire moves forward/backward according to handling of the lever, and the wire is lead through an inside of wire passage on an outside circumference of the upper extension tube formed along an axis direction.

The locking hole preferably has an adjacent sloped surface for guiding one end of the locking projection to an inside of the locking hole.

The present invention permits a user to fold the upper, and lower extension tubes, and to carry out an easy cleaning of even an underside of a sofa, or a bed without holding the extension tube horizontally parallel to the floor, or bending body, reducing tiredness coming from the cleaning work, and enhancing user's convenience.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Reference will now be made in detail to the preferred embodiments of the present invention, examples of which are illustrated in the accompanying drawings.

First Embodiment

Figure 1:
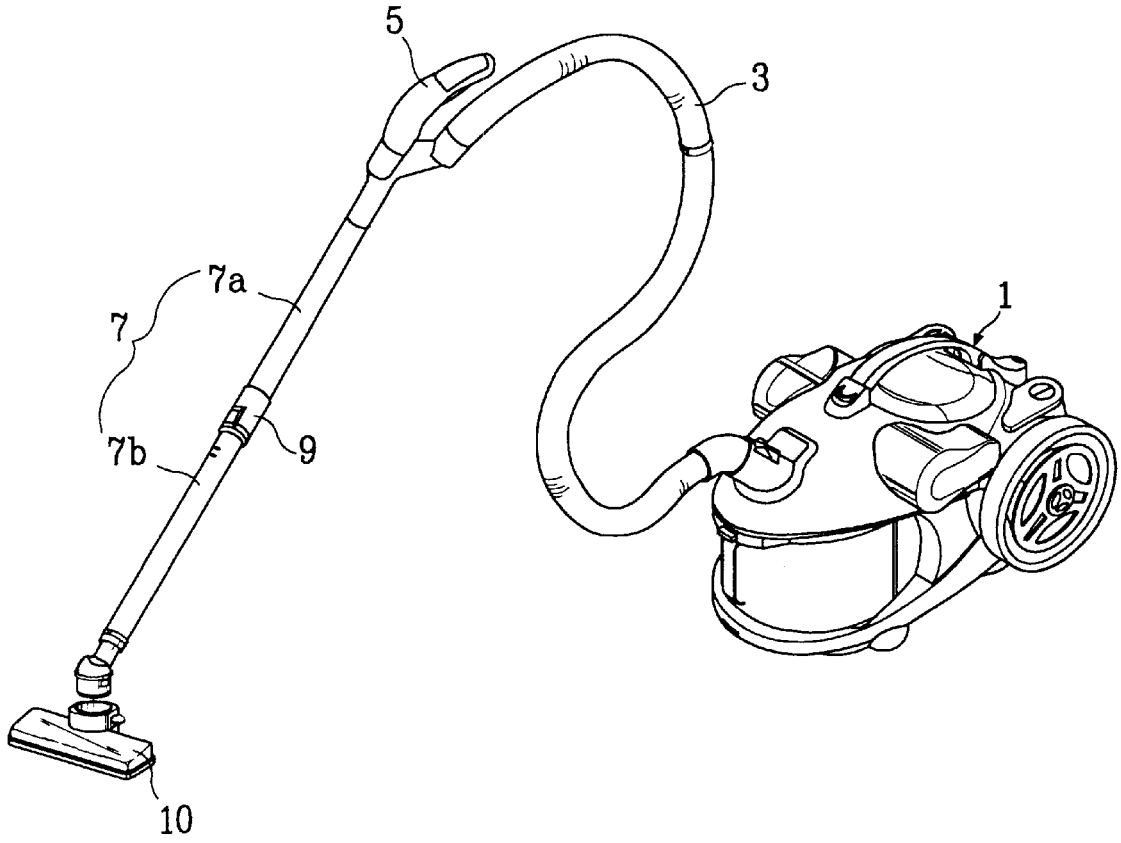
FIG.1 Related Art
FIG. 1 illustrates a perspective view of a related art vacuum cleaner.
Figure 2:
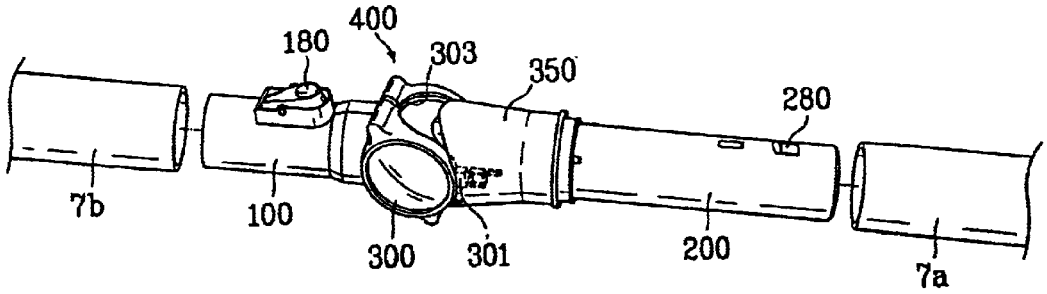
FIG. 2 illustrates a perspective view of a joint part in an extension tube in accordance with a first preferred embodiment of the present invention.
Figure 3:
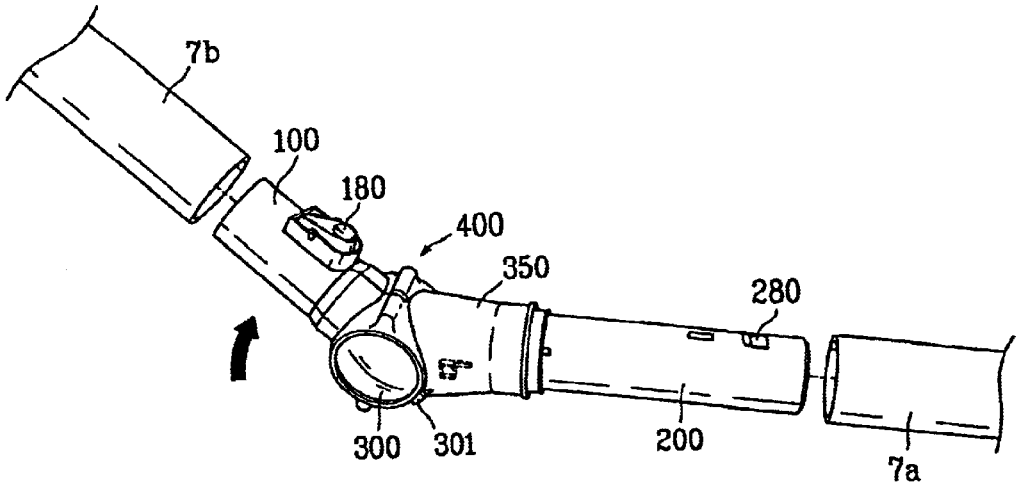
FIG. 3 illustrates a perspective view of the joint part in FIG. 2 in a folded state.
Figure 4:
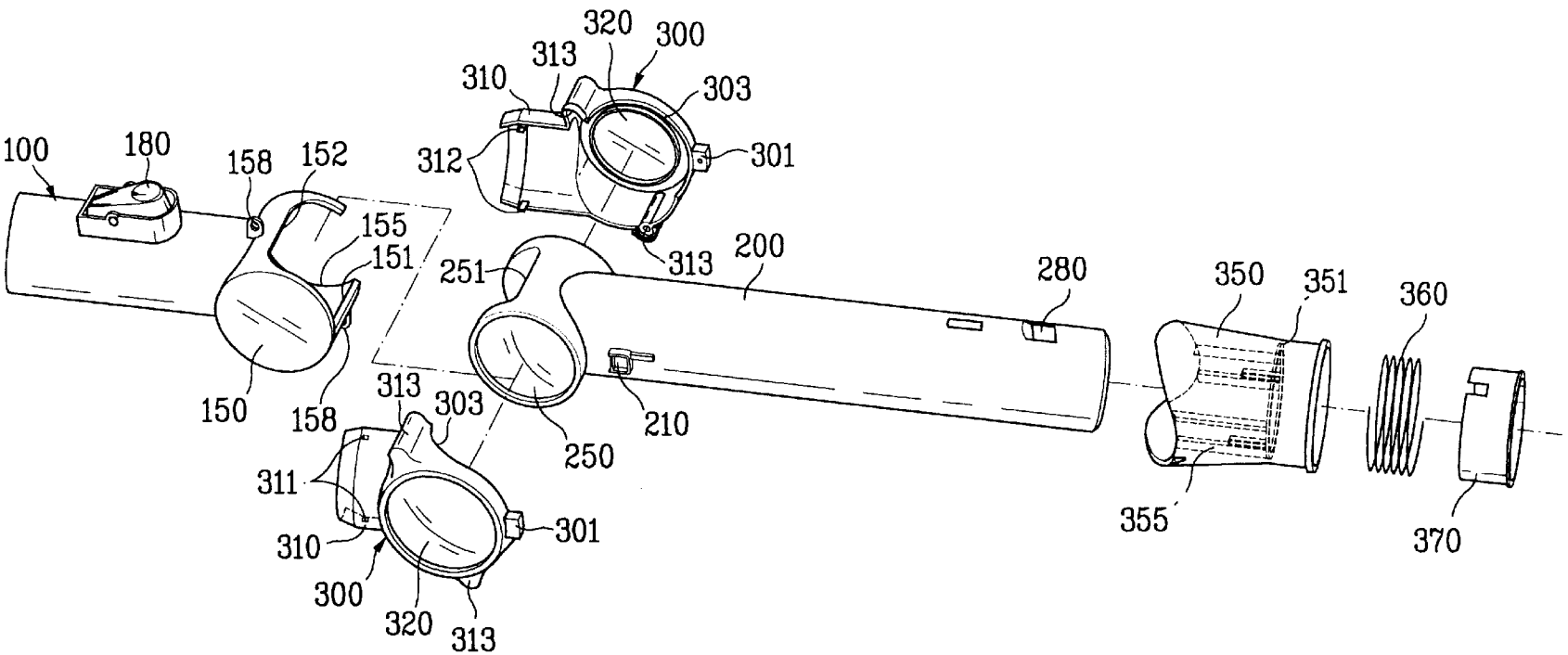
FIG. 4 illustrates a perspective view of a disassembled joint part shown in FIG. 2.

FIG. 2 illustrates a perspective view of a joint part in an extension tube in accordance with a first preferred embodiment of the present invention, FIG. 3 illustrates a perspective view of the joint part in FIG. 2 in a folded state, and FIG. 4 illustrates a perspective view of a disassembled joint part shown in FIG. 2.

Referring to FIGS. 2–4, the extension tube in accordance with a first preferred embodiment of the present invention includes a lower extension tube 7*b*, an upper extension tube 7*a*, and a joint part 400 between the lower extension tube 7*b*, and the upper extension tube 7*a*, thereby permitting the lower extension tube 7*b*, and the upper extension tube 7*a* to bend to a preset angle respectively by the joint part 400, to allow the extension tube folded or unfolded.

The joint part 400 will be explained in more detail.

Referring to FIGS. 2–3, the joint part 400 includes a first hollow tube 100, and a hollow second tube 200 each having a length, a circular section, and one end connected to the lower extension tube 7*b*, or the upper extension tube 7*a*. The first tube 100 has a button 180 provided thereon for use in coupling with the lower extension tube 7*b*, and the second tube 200 has a button 280 provided thereon for use in coupling with the upper extension tube 7*a*. The first, or second tube 100, or 200 has the other end with a rotatable coupling part for making the first tube 100, and the second tube 200 in communication, and rotatable coupling the first tube 100, and the second tube 200 at a preset angle.

A structure of the rotatable coupling part, a rotating shaft permitting the first tube 100, and the second tube 200 to be foldable to a preset angle from a straight line, will be explained.

Referring to FIG. 4, the rotatable coupling part may include a cylindrical hollow receptor part 150 formed at the other end of the first tube 100, and a cylindrical hollow inserting part 250 formed at the other end of the second tube 200 having an outside diameter smaller than an inside diameter of the receptor part 150. That is, the receptor part 150, and the inserting part 250 are formed to have axes perpendicular to the axes of the first, and second tubes 100, and 200 respectively, so as to couple together rotatably by inserting the inserting part 250 through an inserting opening 155 in an axis direction. Both the receptor part 150, and the inserting part 250 have openings 151, and 251 in outer circumferences respectively, so as to make the first tube 100, and the second tube 200 in communication always. The opening 151 in the receptor part 150 has a recess 152 in a direction of rotation of the second tube 200, for permitting the second tube 200 to rotate on the inserting part 250 as a rotation axis by a required angle with respect to the first tube 100. That is, the greater the extension of the width of the recess 152 in the direction of rotation of the second tube 200, the greater the rotatable angle range of the first tube 100 and the second tube 200.

In the meantime, there is one pair of coupling part covers 300 on an outside of the rotatable coupling part each having a fixing part 310 and a cylindrical part 320 for sustaining coupling of the receptor part 150 and the inserting part 250, and covering outsides of the receptor part 150 and the inserting part 250. The fixing parts 310 of the coupling part covers 300 are coupled to an outside circumference of the first tube 100 by a coupling projection 312 and a coupling recess 311, coaxially. The cylindrical parts 320 of the coupling part covers 300 are coupled by fastening fastening means, such as a bolt, to a fastening projection 158 on an outside circumference of the receptor part 150 and the fastening hole 313 in an outside circumference of the cylindrical part 320. The cylindrical parts 320 form an opening 303 in an outside circumference for avoiding interference with the rotation of the first tube 100, and the second tube 200, preferable with a size equal to, or greater than the opening 251 in the receptor part 150.

In the meantime, the joint part 400 includes locking means for locking the upper extension tube 7*a* and the lower extension tube 7*b* on a straight line, or releasing the locking, selectively. The locking means includes a locking projection 301 on each of the cylindrical parts 320 of the coupling part cover 300, a locking member 350 having engagement parts 355 movably fitted on the second tube 200 along an axis direction thereof for engaging with the locking projection 301 to restrict the rotation of the first tube 100 and the second tube 200, and elastic supporting means for exerting an elastic force to the locking member 350 in a direction of engagement of the engagement parts 355 with the locking projections 301. The second tube 200 has guide projections 210 on an outside circumference, and the locking member 350 has the engagement parts 355 in an inside circumference formed parallel to the axis of the second tube 200 to be slidable along the guide projections 210. The elastic supporting means may include a step 351 on an inside circumference of the locking member 350, a ring of supporting member 370 coupled on the second tube 200, and a compression spring 360 having ends biased on the step 351 and the supporting member 370 for exerting an elastic force to the locking member 350 in a direction the engagement parts 355 engage with the locking projections 301.

Under a state the engagement parts 355 of the locking member 350 are engaged with the locking projections 301, the foregoing locking means can restrict relative rotation of the first tube 100 and the second tube 200. Opposite to this, under a state the engagement parts 355 of the locking member 350 are not engaged with the locking projections 301, since the restriction of relative rotation of the first tube 100 and the second tube 200 is removed, the first tube 100 and the second tube 200 can be folded/unfolded within a preset range of angle.

In the meantime, though the extension tube in a vacuum cleaner of the present invention is explained that the joint part 400 is provided between the upper extension tube 7*a* and the lower extension tube 7*b* in the first preferred embodiment of the present invention, the present invention is not limited to this, but the joint part 400 may be fitted on the upper extension tube 7*a*, or the lower extension tube 7*b*.

Figure 5:
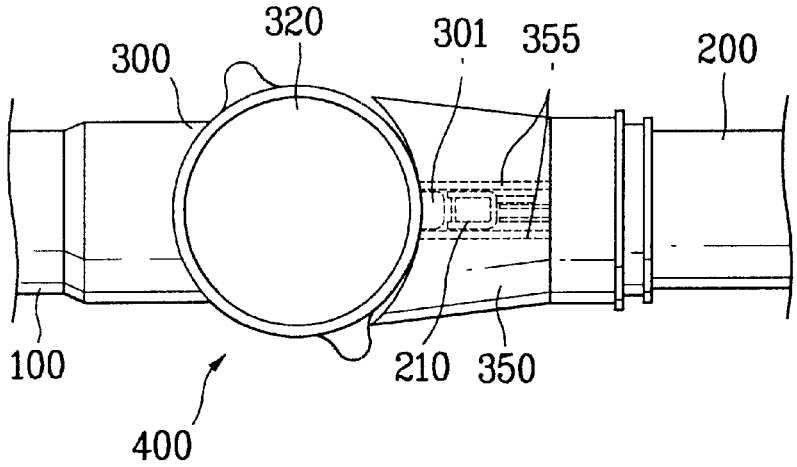
FIG. 5 illustrates an operation state of the locking means in a case the joint part in the extension tube in accordance with a first preferred embodiment of the present invention is set straight.

The operation of the foregoing joint part of the extension tube in accordance with a first preferred embodiment of the present invention will be explained, with reference to FIGS. 5–6. FIG. 5 illustrates an operation state of the locking means in a case the joint part in the extension tube in accordance with a first preferred embodiment of the present invention is set straight, wherein the joint part 400 is set such that the upper, and lower extension tubes (7*a*, and 7*b* in FIG. 2) are on a straight line.

When the upper, and lower extension tubes 7*a*, and 7*b* are set on a straight line, the first tube 100, and the second tube 200 are also set on a straight line, when the locking projections 301 on the cylindrical parts 320 of the coupling part covers 300 abut with the guide projections 310 on the second tube respectively, the locking member 350 is positioned on an outer side of the locking projections 301 and the guide projections 210, and the engagement parts 355 in the inside circumference of the locking member 350 are engaged both with the locking projections 301 and the guide projections 210.

In this instance, since the locking member 350 has an elastic force exerted thereon in a direction the engagement parts 355 and the locking projections 301 are engaged by the compression spring 360 (see FIG. 4), the first tube 100, and the second tube 200 maintain a rotation restricted state. Thus, as the first tube 100 and the second tube 200 are kept on a straight line by the locking member 350, the upper, and lower extension tubes 7*a*, and 7*b* at both ends of the joint part 400 are also kept on a straight line.

Figure 6:
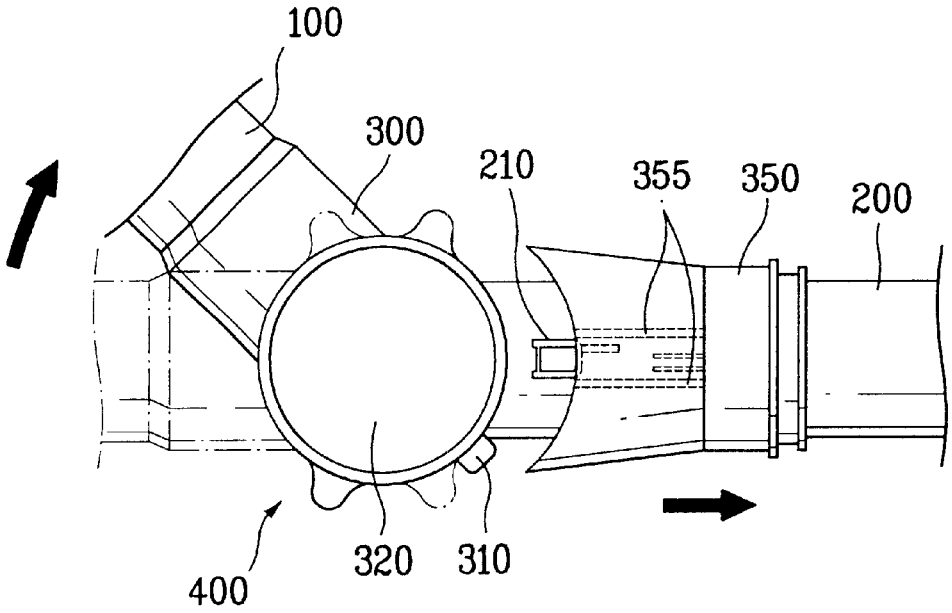
FIG. 6 illustrates an operation state of the locking means in a case the joint part in the extension tube in accordance with a first preferred embodiment of the present invention is folded.
Figure 7:
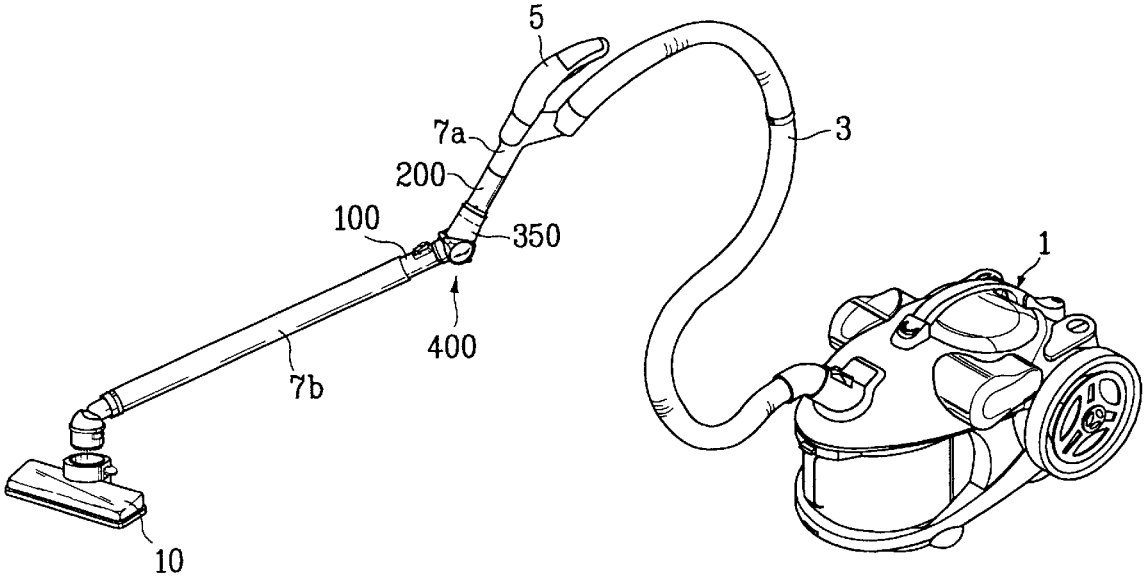
FIG. 7 illustrates a state of use of a vacuum cleaner having the extension tube in accordance with a first preferred embodiment of the present invention applied thereto.

FIG. 6 illustrates an operation state of the locking means in a case the joint part in the extension tube in accordance with a first preferred embodiment of the present invention is folded, wherein a structure of the joint part 400 in a case the upper extension tube 7*a* (see FIG. 3), and the lower extension tube 7*b* (see FIG. 3) are folded to a preset angle is shown.

When it is intended to rotate the joint part 400 set on a straight line, the locking member 350 is moved in a direction opposite to a direction of the elastic force, to release the locking projections 301 of which rotation is restricted by the engagement parts 355. That is, in a state the restriction on rotation of the locking projections 301 by the engagement parts 355 are released, when one of the first, and second tube 100, and 200 is rotated, the first, and second tubes 100, and 200 are rotated taking the inserting part 250 (see FIG. 4) as a rotation shaft.

According to this, the cleaning can be carried out in a state the upper extension tube 7*a* and the lower extension tube 7*b* are folded to a required angle, permitting an easy cleaning of underside of furniture, such as a sofa, or a bed, without holding the extension tube parallel to a floor horizontally, and bending the body accordingly.

If it is intended to return to the folded upper, and lower extension tubes 7*a*, and 7*b* to a state the upper, and lower extension tubes 7*a*, and 7*b* are set on a straight line, by pressing one of the upper, and lower extension tubes 7*a*, and 7*b* in a direction the folded upper, and lower extension tubes 7*a*, and 7*b* are unfolded, the folded upper, and lower extension tubes 7*a*, and 7*b* can be unfolded, easily.

That is, when the folded upper, and lower extension tubes 7*a*, and 7*b* are set on a straight line as the user a part of the upper, and lower extension tubes 7*a*, and 7*b* is pressed in a direction the folded upper, and lower extension tubes 7*a*, and 7*b* are unfolded, the upper, and lower extension tubes 7*a*, and 7*b* return to a state the upper, and lower extension tubes 7*a*, and 7*b* are set on a straight line as the locking projections 301 are engaged with the engagement parts 355 when the locking member 350 moves toward the first tube 100 by the elastic force of the compression spring 360 (FIG. 4).

Second Embodiment

An extension tube in a vacuum cleaner in accordance with a second preferred embodiment of the present invention will be explained.

Figure 8:
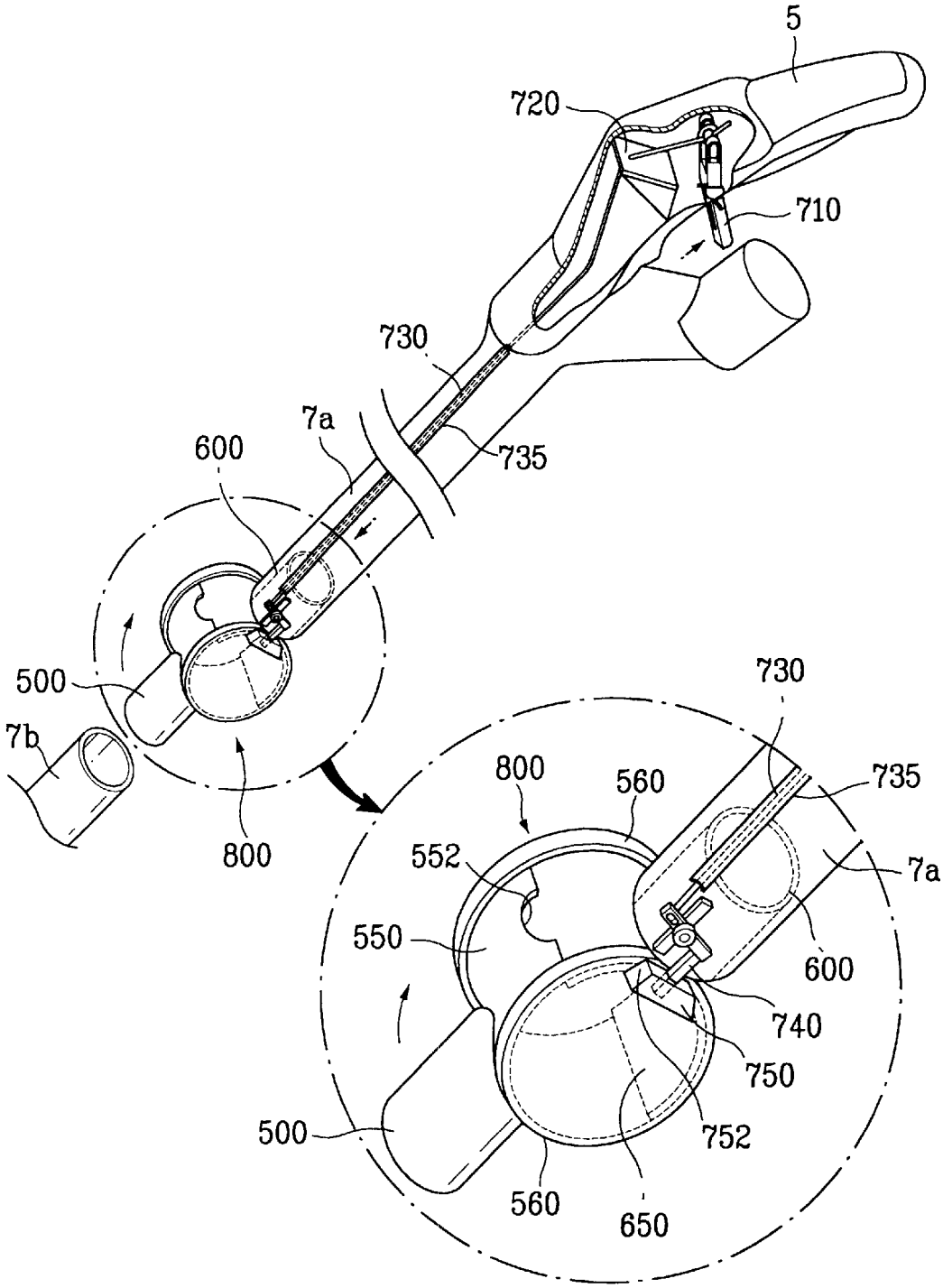
FIG. 8 illustrates a perspective view showing a locking means in the extension tube in accordance with a second preferred embodiment of the present invention before operation.
Figure 9:
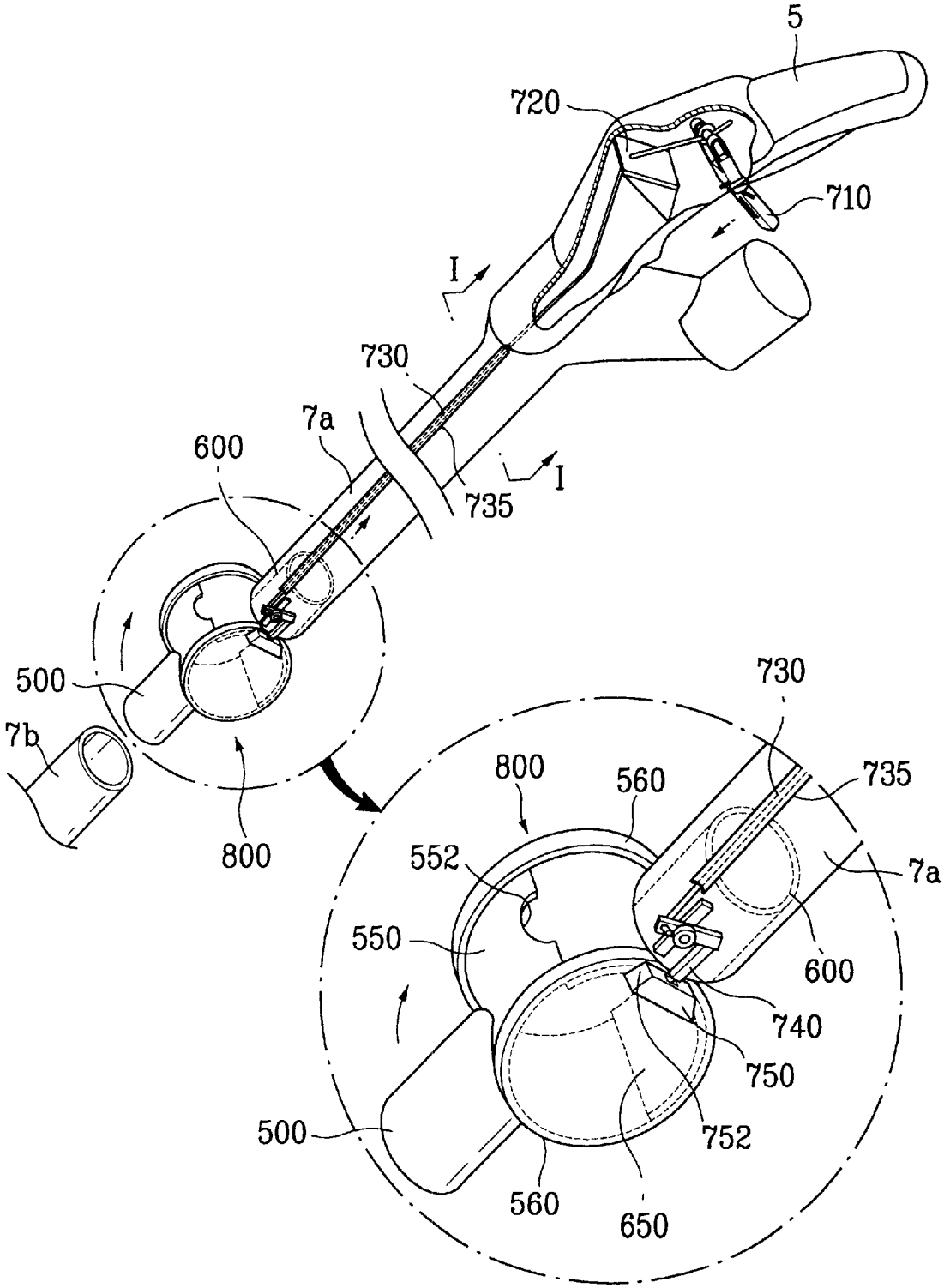
FIG. 9 illustrates a perspective view showing a locking means in the extension tube in accordance with a second preferred embodiment of the present invention after operation.

Referring to FIGS. 8 and 9, the extension tube in a vacuum cleaner in accordance with a second preferred embodiment of the present invention includes an upper extension tube 7*a*, a lower extension tube 7*b*, a joint part 800 between the upper extension tube 7*a* and the lower extension tube 7*b*, and locking means at a hand grip for permitting selective folding of the joint part 800.

Figure 10:
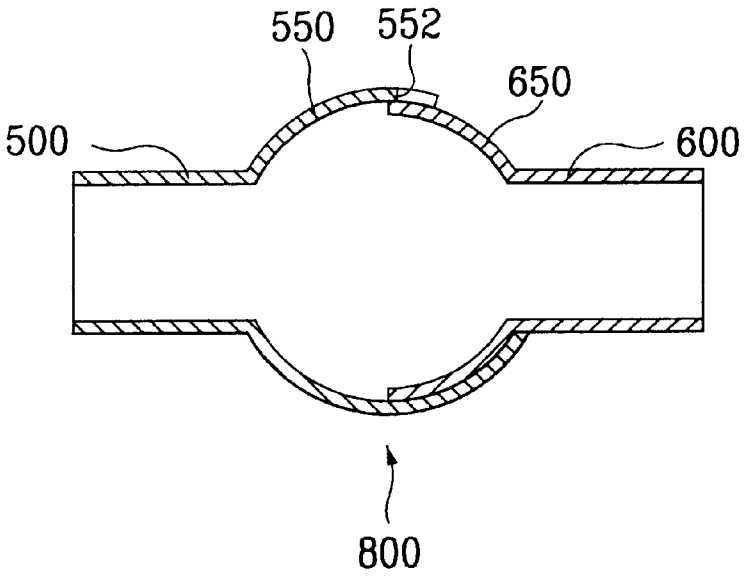
FIG. 10 illustrates a section of the joint part in accordance with a second preferred embodiment of the present invention; and, FIG. 11 illustrates a section across a line I—I.

The joint part 800 will be explained in more detail, referring to FIG. 10 illustrating a section of the joint part in accordance with a second preferred embodiment of the present invention.

Alike the joint part 400 in the foregoing first embodiment joint part 400, the joint part 800 includes a first tube 500, and a second tube 600 each having one end detachably connected to the lower extension tube 7*b*, or the upper extension tube 7*a*, and a rotatable coupling part for making the other ends of the first, and second tubes 500, and 600 in communication, and the first, and second tubes 500, and 600 rotatable relative to each other to a preset angle.

The rotatable coupling part includes a cylindrical hollow receptor part 550 at the other end of the first tube 500, and an cylindrical hollow inserting part 650 at the other end of the second tube 600 having an outside diameter smaller than an inside diameter of the receptor part 550 for inserting inside of the receptor part 660. Accordingly, the first tube 500 is made rotatable with respect to the second tube 600 taking the inserting part 650 as a rotation shaft. Since a part of an outside circumference of each of the receptor part 550, and the inserting part 650 is opened, the first tube 500 and the second tube 600 are made to be in communication. There are one pair of circular plates 560 at sides of the receptor part 550 and the inserting part 650, for sustaining the coupling of the rotatable coupling part and covering an outside of the rotatable coupling part. The circular plates 560 are coupled with the receptor part 550 so as to be movable together with the first tube 500.

The extension tube in a vacuum cleaner in accordance with a second preferred embodiment of the present invention includes locking means so that the user can fold the joint part 800 selectively, which will be explained.

The circular plate 560 has a locking block with a locking hole 750 formed therein, and surfaces 752 sloped toward the upper extension tube 7*a* such that a width of the block becomes the smaller as it goes toward the upper extension tube 7*a*. There is a locking projection 740 rotatably fitted on a shaft on an outside circumference of the upper extension tube 7*a* for inserting in the locking hole 750.

The locking projection 740 in a "]" form is rotatable on a rotation shaft within a preset range of angle for inserting in/pulling out of the locking hole 750. The other end of the locking projection 740 is connected to one end of steel wire 730, the other end of which is passed through a hole in a support plate 720 formed in the hand grip 5, and connected to a lever 710.

While one end of the lever 710 is located inside of the hand grip 5 in a state one of the lever 710 is connected to the other end of the wire 730, the other end of the lever 710 is projected outside of the hand grip 5 partly, for easy handling by the user. Though not shown, there is an elastic member, such as a spring, at one end of the lever 710 connected to the wire, for exerting an elastic force in a direction the wire 730 is pulled toward the lever 710 side.

Figure 11:
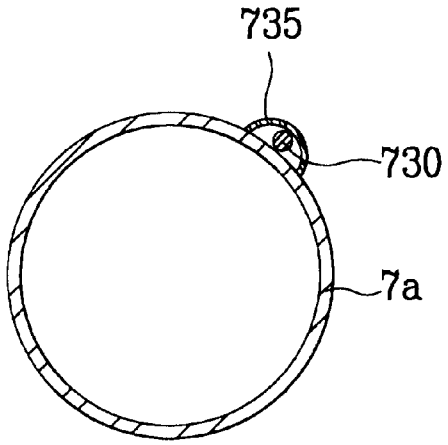

As shown in FIG. 11, it is preferable that the wire 730 is lead through an inside of wire passage 735 on an outside circumference of the upper extension tube 7*a* formed along an axis direction, thereby preventing exposure to avoid contact or interference during cleaning.

The operation of the foregoing extension tube in accordance with a second preferred embodiment of the present invention will be explained.

When it is intended to clean underside of a sofa, or a bed in the middle of if cleaning by using a vacuum cleaner, with the upper, and lower extension tubes 7*a*, and 7*b* set on a straight line, the lever 710 at the hand grip 5 is pulled in a direction of an arrow in FIG. 8.

Referring to FIG. 10, when the lever 710 is pulled, as one end of the lever 710 connected to the wire 730 moves in a direction of the support plate 720, a force is transmitted as the wire 730 is pushed toward the joint 800, to rotate the locking projection 740 to a preset angle. Then, as shown in FIG. 9, as one end of the locking projection 740 in a state inserted in the locking hole 750 is drawn out of the locking hole 750, the joint part 800 becomes free to rotate. When a force is applied to the hand grip 5 in a direction the joint part 800 is folded under a state rotation of the joint is freed, the upper, and lower extension tubes 7*a*, and 7*b* are folded to a preset angle, permitting an easy cleaning of the under side of the sofa, or the bed.

When the user ceases application of the force to the lever 710, the lever 710 moves to an original position by a restoring force of the elastic means supporting one end of the lever 710, causing a force exerted to the locking projection 740 connected to the wire 730 in a direction restoring to an original position.

When the user sets the upper, and lower extension tubes 7*a*, and 7*b* on a straight line again after cleaning of the under side of the sofa, and the bed is finished, one end of the locking projection 740 moves along the sloped surface of the locking block, and is inserted in the locking hole 750, thereby restricting rotation of the joint part 800.

Alike the first embodiment, the second embodiment of the present invention requires, not two hands in folding or unfolding the extension tube, but one hand, gripping the hand grip 5.

It will be apparent to those skilled in the art that various modifications and variations can be made in the extension tube in a vacuum cleaner of the present invention without departing from the spirit or scope of the invention. Thus, it is intended that the present invention cover the modifications and variations of this invention provided they come within the scope of the appended claims and their equivalents.

As has been explained, the extension tube in a vacuum cleaner of the present invention has the following advantages.

The rotatable joint part fitted between the upper extension tube, and the lower extension tube permits the user to fold the upper, and lower extension tubes, and to carry out an easy cleaning of even an underside of a sofa, or a bed without holding the extension tube horizontally parallel to the floor, or bending body, thereby reducing tiredness coming from the cleaning work, and enhancing user's convenience.

What is claimed is:

1. An extension tube in a vacuum cleaner, comprising:

a lower extension tube for drawing dust laden air through an air suction nozzle fitted at one end;

an upper extension tube having one end connected to a hand grip extended to a body of the vacuum cleaner for passing the dust laden air drawn through the lower extension tube;

a joint part including:

a rotatable coupling part provided between the lower extension tube and the upper extension tube for guiding the dust laden air from the lower extension tube to the upper extension tube, the rotatable coupling part comprising a receptor part and an inserting part which is rotatably coupled to the receptor part by being inserted into the receptor part, and coupling part covers covering an outside of the rotatable coupling part for securing the coupling part between the receptor part and the inserting part; and, locking means for releasably locking the joint part to fold/unfold the joint part, selectively.

2. The extension tube as claimed in claim 1, wherein the joint part further includes:

a first tube having one end connected to the lower extension tube and the other end connected to the rotatable coupling part; and a second tube having one end connected to the upper extension tube and the other end connected to the rotatable coupling part, wherein the rotatable coupling part makes the other ends of the first tube and the second tube to be in communication, and couples the first tube and the second tube to be foldable relative to each other to a preset angle, and wherein the coupling part covers are fitted to an outside of the rotatable coupling part so as not to interfere with the rotation of the rotatable coupling part, and coupled to an outside circumference of the first tube, coaxially.

3. The extension tube as claimed in claim 2, wherein the locking means includes:

a locking projection on each of the cylindrical parts of the coupling part covers of the joint part;

a locking member movably fitted on the second tube along an axis direction thereof having engagement parts for engaging with the locking projections to restrict rotation of the joint part; and elastic supporting means for exerting an elastic force to the locking member in a direction of engagement of the engagement parts with the locking projections.

4. The extension tube as claimed in claim 3, wherein the locking member includes an inside diameter greater than an outside diameter of the second tube, and the engagement parts in an inside circumference, and the second tube of the joint part has guide projections on an outside circumference for guiding the engagement parts along an axis direction of the second tube.

5. The extension tube as claimed in claim 3, wherein the elastic supporting means includes:

a step on an inside circumference of the locking member;

a supporting member fixed to the second tube; and a compression spring having ends biased on the step and the supporting member for exerting an elastic force to the locking member in a direction the engagement parts engage with the locking projections.

6. The extension tube as claimed in claim 1, wherein the joint part is fitted to the lower extension tube, or the upper extension tube.

7. An extension tube in a vacuum cleaner, comprising:

a lower extension tube for drawing dust laden air through an air suction nozzle fitted at one end;

an upper extension tube having one end connected to a hand grip extended to a body of the vacuum cleaner for passing the dust laden air drawn through the lower extension tube;

a joint part connected to the other ends of the lower extension tube and the upper extension tube for making the lower extension tube and the upper extension tube foldable relative to each other to a preset angle; and, locking means for locking the joint part to fold/unfold the joint part, selectively, wherein the locking means includes:

a lever at the hand grip;

wire having one end connected to the lever;

a locking projection connected to the other end of the wire, and fitted to the upper extension tube; and a locking hole in one side circular plate for restricting rotation of the joint part as a part of the locking projection is inserted therein.

8. The extension tube as claimed in claim 7, wherein the locking projection is rotatably fitted to the upper extension tube for selective insertion in the locking hole as the wire moves forward/backward according to handling of the lever.

9. The extension tube as claimed in claim 7, wherein the wire is lead through an inside of wire passage on an outside circumference of the upper extension tube formed along an axis direction.

10. The extension tube as claimed in claim 7, wherein the locking hole has an adjacent sloped surface for guiding one end of the locking projection to an inside of the locking hole.

11. An extension tube in a vacuum cleaner, comprising:

a lower extension tube for drawing dust laden air through an air suction nozzle fitted at one end;

an upper extension tube having one end connected to a hand grip extended to a body of the vacuum cleaner for passing the dust laden air drawn through the lower extension tube;

a joint part including:

a first tube having one end connected to the lower extension tube;

a second tube having one end connected to the upper extension tube;

a rotatable coupling part for making the other ends of the first tube, and the second tube to be in communication, and coupling the first tube and the second tube to be foldable relative to each other to a preset angle; and coupling part covers fitted to an outside of the rotatable coupling part not to interfere the rotation of the rotatable coupling part, and coupled to an outside circumference of the first tube, coaxially; and, locking means including:

a locking projection on each of the cylindrical parts of the coupling part covers of the joint part;

a locking member movably fitted on the second tube along an axis direction thereof having engagement parts for engaging with the locking projections to restrict rotation of the joint part; and elastic supporting means for exerting an elastic force to the locking member in a direction of engagement of the engagement parts with the locking projections.

12. The extension tube as claimed in claim 11, wherein the elastic supporting means includes:

a step on an inside circumference of the locking member;

a supporting member fixed to the second tube; and a compression spring having ends biased on the step and the supporting member for exerting an elastic force to the locking member in a direction the engagement parts engage with the locking projections.

13. An extension tube in a vacuum cleaner, comprising:

a lower extension tube for drawing dust laden air through an air suction nozzle fitted at one end;

an upper extension tube having one end connected to a hand grip extended to a body of the vacuum cleaner for passing the dust laden air drawn through the lower extension tube;

a joint part including:

a first tube having one end connected to the lower extension tube;

a second tube having one end connected to the upper extension tube;

a rotatable coupling part for making the other ends of the first tube, and the second tube to be in communication, and coupling the first tube and the second tube to be foldable relative to each other to a preset angle; and circular plates covered on sides of the rotatable coupling part, and rotatably fitted together with the first tube; and, locking means including:

a lever at the hand grip;

wire having one end connected to the lever;

a locking projection connected to the other end of the wire, and fitted to the upper extension tube; and a locking hole in one side circular plate for restricting rotation of the joint part as a part of the locking projection is inserted therein.

14. The extension tube as claimed in claim 13, wherein the locking projection is rotatably fitted to the upper extension tube for selective insertion in the locking hole as the wire moves forward/backward according to handling of the lever.

15. The extension tube as claimed in claim 13, wherein the wire is lead through an inside of wire passage on an outside circumference of the upper extension tube formed along an axis direction.

16. The extension tube as claimed in claim 13, wherein the locking hole has an adjacent sloped surface for guiding one end of the locking projection to an inside of the locking hole.

17. The extension tube as claimed in claim 11 or 13, wherein the rotatable coupling part includes:

a cylindrical hollow receptor part formed at the other end of the first tube to have an axis perpendicular to an axis of the first tube, and having an opening in an outside circumference in communication with the second tube; and a cylindrical hollow inserting part formed at the other end of the second tube so as to be inserted inside of the receptor part to serve as a rotation shaft of the first tube, and having an opening in an outside circumference in communication with the first tube.

18. The extension tube as claimed in claim 17, wherein the receptor part has a recess in the opening thereof in a rotation direction of the second tube for allowing the second tube to rotate a preset angle with respect to the first tube.

19. The extension tube as claimed in claim 17, wherein the receptor part has an opening in one side for inserting the inserting part in an axial direction.

20. The extension tube as claimed in claim 11 or 13, wherein the joint part is fitted to the lower extension tube, or the upper extension tube.

21. An extension tube in a vacuum cleaner, comprising:

a lower extension tube for drawing dust laden air through an air suction nozzle fitted at one end;

an upper extension tube having one end connected to a hand grip extended to a body of the vacuum cleaner for passing the dust laden air drawn through the lower extension tube;

a joint part including:

a rotatable coupling part provided between the lower extension tube and the upper extension tube for guiding the dust laden air from the lower extension tube to the upper extension tube, the rotatable coupling part comprising a receptor part and an inserting part which is rotatably coupled to the receptor part by being inserted into the receptor part, and a pair of circular plates covering sides of the receptor part and the inserting part of the rotatable coupling part for securing the coupling part between the receptor part and the inserting part; and locking means for releasably locking the joint part to fold/unfold the joint part, selectively.

22. The extension tube as claimed in claim 21, wherein the joint part further includes:

a first tube having one end connected to the lower extension tube and the other end connected to the rotatable coupling part; and a second tube having one end connected to the upper extension tube and the other end connected to the rotatable coupling part, wherein the rotatable coupling part makes the other ends of the first tube and the second tube to be in communication, and couples the first tube and the second tube to be foldable relative to each other to a preset angle, and wherein the circular plates are rotatably fitted together with the first tube.

23. The extension tube as claimed in claim 2 or 22, wherein the receptor part is a cylindrical hollow part formed at the other end of the first tube to have an axis perpendicular to an axis of the first tube, and having an opening in an outside circumference in communication with the second tube, and wherein the inserting part is a cylindrical hollow part formed at the other end of the second tube so as to be inserted inside of the receptor part to serve as a rotation shaft of the first tube, and having an opening in an outside circumference in communication with the first tube.

24. The extension tube as claimed in claim 23, wherein the receptor part has a recess in the opening thereof in a rotation direction of the second tube for allowing the second tube to rotate a preset angle with respect to the first tube.

25. The extension tube as claimed in claim 23, wherein the receptor part has an opening in one side for inserting the inserting part in an axial direction.

26. An extension tube in a vacuum cleaner, comprising:

a lower extension tube for drawing dust laden air through an air suction nozzle fitted at one end;

an upper extension tube having one end connected to a hand grip extended to a body of the vacuum cleaner for passing the dust laden air drawn through the lower extension tube;

a joint part connected to the other ends of the lower extension tube and the upper extension tube for making the lower extension tube and the upper extension tube foldable relative to each other to a preset angle, the joint part including:

a first tube having one end connected to the lower extension tube;

a second tube having one end connected to the upper extension tube; and a rotatable coupling part for making the other ends of the first tube and the second tube to be in communication, and coupling the first tube and the second tube to be foldable relative to each other to the preset angle, the rotatable coupling part including:

a cylindrical hollow receptor part formed at the other end of the first tube to have an axis perpendicular to an axis of the first tube, and having an opening in an outside circumference in communication with the second tube; and a cylindrical hollow inserting part formed at the other end of the second tube so as to be inserted inside of the receptor part to serve as a rotation shaft of the first tube, and having an opening in an outside circumference in communication with the first tube; and, locking means for locking the joint part to fold/unfold the joint part, selectively.

* * * * *